US007000278B2

(12) United States Patent
Bruntz et al.

(10) Patent No.: US 7,000,278 B2
(45) Date of Patent: Feb. 21, 2006

(54) METHOD AND APPARATUS FOR END OF CYCLE SIGNAL FOR LAUNDRY APPLIANCE

(75) Inventors: Jordan S. Bruntz, Baxter, IA (US); Howell H. Chiles, Altoona, IA (US)

(73) Assignee: Maytag Corporation, Newton, IA (US)

( * ) Notice: Subject to any disclaimer, the term of this patent is extended or adjusted under 35 U.S.C. 154(b) by 504 days.

(21) Appl. No.: 10/201,040

(22) Filed: Jul. 23, 2002

(65) Prior Publication Data

US 2004/0016265 A1 Jan. 29, 2004

(51) Int. Cl.
*F06F 33/02* (2006.01)

(52) U.S. Cl. ..... 8/159; 68/12.02; 68/12.12; 68/12.16; 68/12.23

(58) Field of Classification Search ..... 134/113; 68/12.02, 12.12, 12.16, 12.17, 12.23
See application file for complete search history.

(56) References Cited

U.S. PATENT DOCUMENTS

| | | | | | |
|---|---|---|---|---|---|
| 1,383,533 | A | * | 7/1921 | Crook | 307/141.4 |
| 2,056,833 | A | * | 10/1936 | Davis | 68/12.09 |
| 2,197,294 | A | * | 4/1940 | Brockbank | 222/59 |
| 2,816,428 | A | * | 12/1957 | Forse | 68/17 R |
| 2,885,876 | A | * | 5/1959 | Re | 68/12.05 |
| 3,430,223 | A | * | 2/1969 | Martiniak et al. | 340/309.2 |
| 3,553,483 | A | * | 1/1971 | Jarvis | 307/141 |
| 3,762,064 | A | | 10/1973 | Offutt | |
| 3,828,199 | A | * | 8/1974 | Sakai et al. | 307/141 |
| 4,237,565 | A | * | 12/1980 | Torita et al. | 8/158 |
| 4,335,592 | A | * | 6/1982 | Torita | 68/12.18 |
| 4,468,600 | A | * | 8/1984 | Barthel et al. | 318/452 |
| 4,733,547 | A | * | 3/1988 | Honda | 68/12.05 |
| 4,803,854 | A | * | 2/1989 | Kikuchi et al. | 68/12.27 |
| 4,838,050 | A | * | 6/1989 | Azuma | 68/12.23 |
| 4,977,394 | A | * | 12/1990 | Manson et al. | 340/679 |
| 5,096,347 | A | * | 3/1992 | Kumagai et al. | 409/233 |
| 5,113,124 | A | * | 5/1992 | Hamilton et al. | 318/578 |
| 5,150,489 | A | * | 9/1992 | Kaji et al. | 8/159 |
| 5,211,037 | A | | 5/1993 | Adamski et al. | |
| 5,671,135 | A | * | 9/1997 | Jorgensen et al. | 700/76 |
| 5,897,671 | A | * | 4/1999 | Newman et al. | 8/158 |
| 6,020,698 | A | | 2/2000 | Stenger et al. | |
| 6,160,245 | A | * | 12/2000 | Broker et al. | 219/506 |
| 6,844,513 | B1 | * | 1/2005 | Lipp et al. | 200/179 |
| 2002/0070848 | A1 | * | 6/2002 | Adler | 340/311.2 |
| 2003/0116558 | A1 | * | 6/2003 | Lipp et al. | 219/493 |

* cited by examiner

FOREIGN PATENT DOCUMENTS

JP 62-217993 * 9/1987

*Primary Examiner*—Frankie L. Stinson
(74) *Attorney, Agent, or Firm*—McKee, Voorhees & Sease, P.L.C.

(57) ABSTRACT

A method is disclosed for producing an end of cycle for a laundry appliance having a drive motor, a timer motor, and at least one water valve. The method includes determining that the drive motor was previously running and is presently turned off, determining that the timer motor is not currently running, determining that the water valves are closed, and producing a signal to indicate the end of the laundry cycle.

A laundry appliance is disclosed. The laundry appliance includes a drive motor, a timer motor, at least one water valve, and an intelligent control electrically connected to the drive motor, the timer motor, and the at least one water valve. The intelligent control is adapted for determining an end of cycle signal by determining that the drive motor is turned off, determining that the timer motor is not running, and determining that the water valve is closed.

16 Claims, 8 Drawing Sheets

A
B
C
D
E
F
G
H
I
J
K
L
M
N
O
P
Q
W-C H-C
C-C W-C
W-C C-C
64
4
B
T
66
3
T
B
TEMP CONT. SWITCH (OFF)
TEMP CONTROL
TEMP CONTROL LIGHT
14
TIMER MOTOR
WATER VALVE
16
COLD
HOT
CHIME SWITCH
22
90
(OFF)
HI
LO
CHIME
X-RINSE (OFF)
FULL
EMPTY
WATER LEVEL SWITCH

METHOD AND APPARATUS FOR END OF CYCLE SIGNAL FOR LAUNDRY APPLIANCE

BACKGROUND OF THE INVENTION

This invention relates to a method and apparatus for a laundry appliance. More specifically, this invention relates to a laundry appliance that provides for determining an end of cycle using an intelligent control.

Laundry appliances, and in particular high-end laundry appliances, have conventionally used electromechanical timers. Other laundry appliances may use microprocessors to perform control functions. In systems using an electromechanical timer, the timer has a number of different cams, each of which are associated with different functions of the laundry appliance. In the course of a laundry cycle, sequences of functions are performed. Such functions include washing, rinsing, spinning and various other functions. The timing of the occurrences of these functions is determined by the electromechanical timer and its associated cams.

What is desirable is to determine the end of the laundry cycle. Although such a determination could be made using the electromechanical timer, there are a limited number of cams available and the cost of adding additional cams would be great and therefore impractical.

Thus, it is a primary object of the present invention to provide a method and apparatus for a laundry appliance that improves over the state of the art.

It is a further object of the present invention to provide a method and apparatus for a laundry appliance that can be used with an electromechanical timer-based laundry appliance.

It is a further object of the present invention to provide for an end of cycle signal for the laundry appliance.

Another object of the present invention is to provide an end of cycle signal for a laundry appliance that can be used to sound an audible chime.

Yet another object of the present invention is to provide an end of cycle signal for the laundry appliance without using an additional electromechanical timer-based timer circuit.

It is another object of the present invention to provide an end of cycle signal for a laundry appliance that is not cost prohibitive.

These and/or other objects, features, or advantages of the present invention will become apparent from the specification and claims that follow.

SUMMARY OF THE INVENTION

The present invention is a method and apparatus for a laundry appliance that provides for the creation of an end of cycle signal. The present invention can be used in electromechanical timer based laundry appliance without requiring an additional timer based circuit.

According to one aspect of the invention, a method of producing an end of cycle for a laundry appliance having a drive motor, a timer motor, and at least one water valve includes determining that the drive motor was previously running and is presently turned off, determining that the timer motor is not currently running, determining that the water valves are closed, and producing a signal to indicate an end of the laundry cycle. An intelligent control such as a microprocessor or microcontroller can be used to monitor timer circuits associated with the electromechanical timer without requiring use of a separate electromechanical timer circuit.

Another aspect of the present invention includes a laundry appliance. The laundry appliance includes a drive motor, a timer motor, at least one water valve, and an intelligent control electrically connected to the drive motor, the timer motor, and the at least one water valve. The intelligent control is adapted for determining an end of cycle by determining that the drive motor is turned off, determining that the timer motor is not running, and determining that the at least one water valve is closed. The laundry appliance can include an audio circuit electrically connected to the intelligent control for receiving the end of cycle signal and producing an audible tone. The audible tone can be a chime.

DETAILED DESCRIPTION OF THE INVENTION

Figure 1:
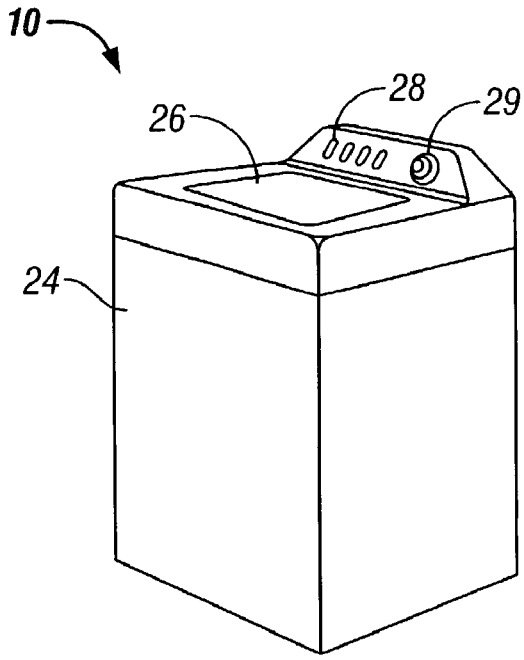
FIG. 1 is a perspective view of a laundry appliance according to one embodiment of the present invention.

FIG. 1 illustrates a laundry appliance 10. The laundry appliance 10 includes a cabinet 24 with a lid 26. A control panel 28 is also shown. The control panel 28 shown includes a dial 29 of an electromechanical timer. A laundry appliance according to the present invention need not have a dial 29 as shown but can have other types of controls.

Figure 2:
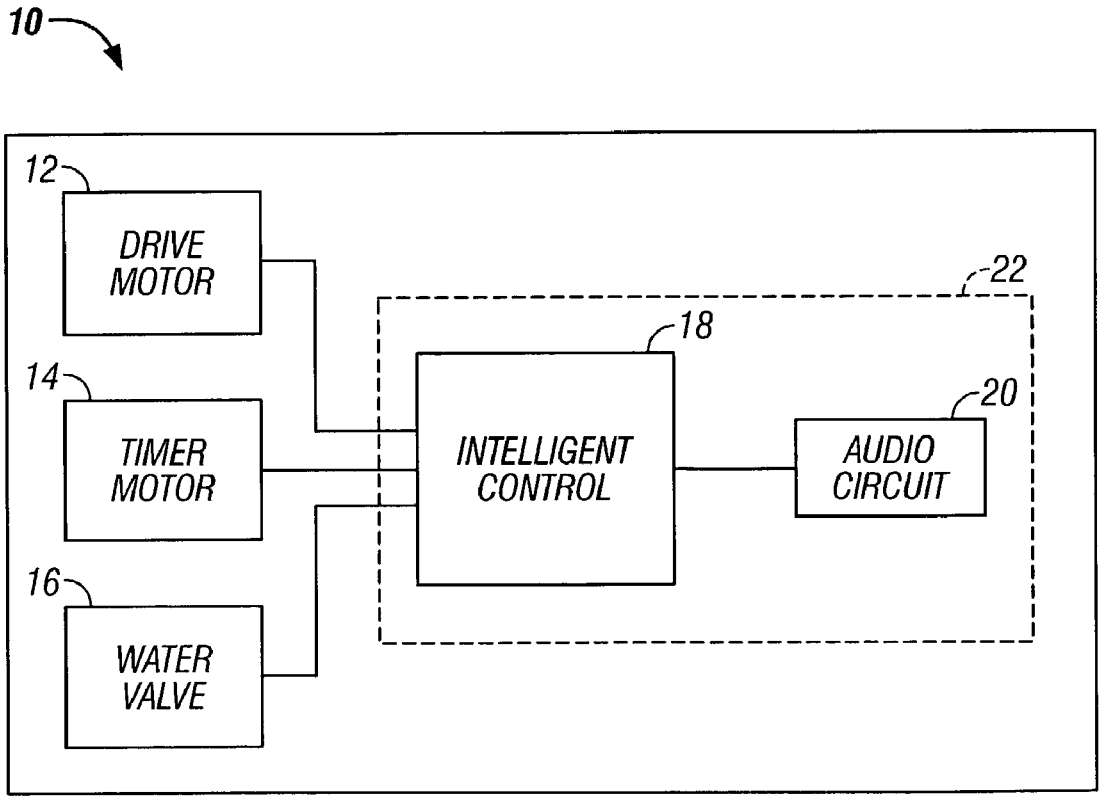
FIG. 2 is a block diagram of an end of cycle circuit according to one embodiment of the present invention.

FIG. 2 provides a block diagram of the laundry appliance 10. The laundry appliance 10 includes a drive motor 12, a timer 14, and a water valve 16. An intelligent control 18 such as a microcontroller, microprocessor, complex programmable logic device (CPLD) or programmable system on a chip (PSOC) or other intelligent control is electrically connected to the drive motor 12, the timer motor 14, and at least one water valve 16. Preferably the intelligent control 18 selected is low cost. One example of an intelligent control that can be used is a Microchip PIC 12C508A available from Microchip Technology Inc. This device is an 8-bit microcontroller having six I/O pins that is low cost and convenient. The present invention is not, however, limited to any particular selection of an intelligent control. It should be appreciated by one skilled in the art that the laundry appliance 10 can include multiple water valves 16. Water valves may be associated with, dispensing detergent, fabric softener and bleach.

The intelligent control 18 is also electrically connected to an audio circuit 20. When the intelligent control 18 determines that the end of the laundry cycle has occurred, the intelligent control 18 can signal the audio circuit 20 to sound a chime or otherwise produce an audio alert signal so that a user of the laundry appliance 10 will know that the end of the cycle has occurred. A chime unit 22 includes both the intelligent control 18 and the audio circuit 20.

The intelligent control 18 as shown is not used to control the functions and timing of the laundry appliance 10. Rather, the intelligent control 18 is used to monitor or sense various signals present in the timing circuits associated with the cams of the timer 14. The intelligent control 18 monitors these various inputs to determine when the end of the laundry cycle has occurred and create a resulting end of laundry cycle signal. The end of laundry cycle signal, can be used to create an audible signal to serve as an audio alert to a user. Preferably the audible signal is a chime.

Figure 3:
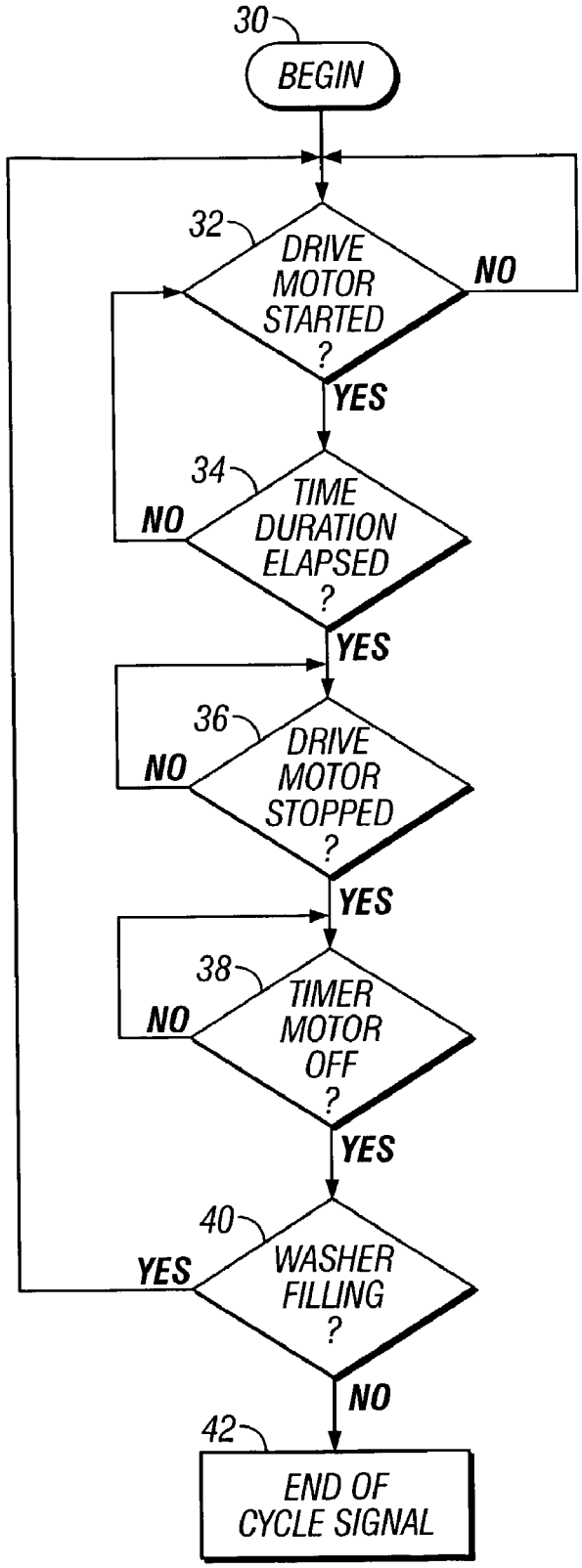
FIG. 3 is a flow diagram for determining an end of cycle according to one embodiment of the present invention.

FIG. 3 provides a flow diagram of one method according to the present invention. According to the method of FIG. 3, a determination is made as to whether an end of cycle has been reached. The method begins in step 30. The method can be performed by a processor, microprocessor, microcontroller or other intelligent control. In step 32, a determination is made as to whether the drive motor has started. Once the drive motor has started, in step 34 the intelligent control 18 monitors to determine if a particular time duration has lapsed. The time duration is preferably approximately 30 seconds, however, other time durations can be used. The time duration exists to prevent nuisance trips or false alarms. These nuisance trips can happen due to the consumer manually turning the dial or due to slight differences in the sequencing of the open/close events of various timer circuits. Once this time duration has elapsed, in step 36 a determination is made as to whether the drive motor 12 has stopped. Once the drive motor 12 has stopped, in step 38 a determination is made as to whether the timer motor 14 has been turned off. Once the timer motor 14 has been turned off, in step 40 a determination is made as to whether the laundry appliance or washer 10 has stopped filling. If not, the flow control is returned to step 32. If the laundry appliance 10 has stopped filling, then in step 42 the intelligent control 18 determines that an end of cycle has occurred and an end of cycle signal is produced. The intelligent control 18 can make these determinations based on the state of the associated inputs.

Figure 4A:
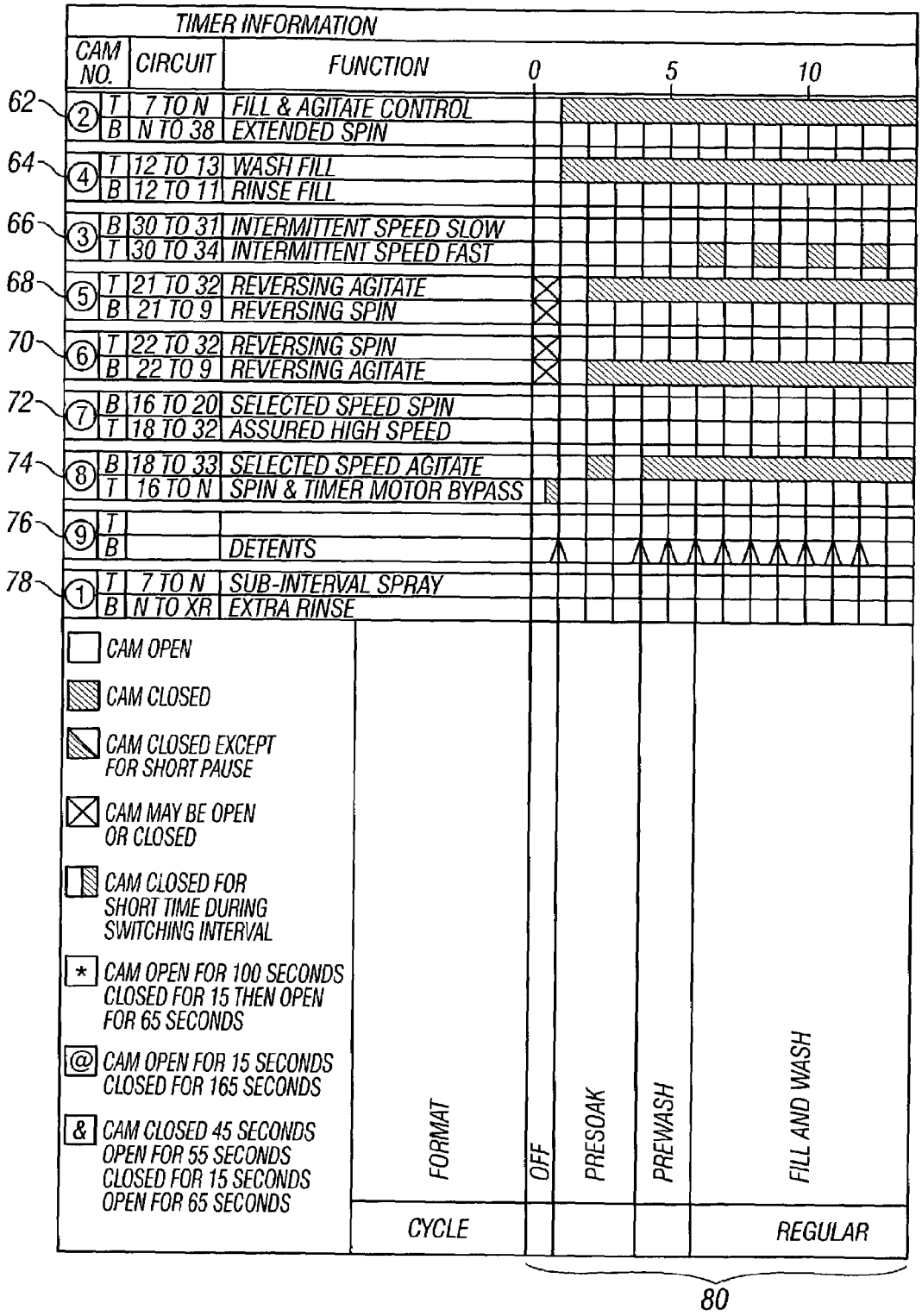
FIGS. 4A–4C show a time chart for the electromechanical timer according to one embodiment of the present invention.
Figure 4B:
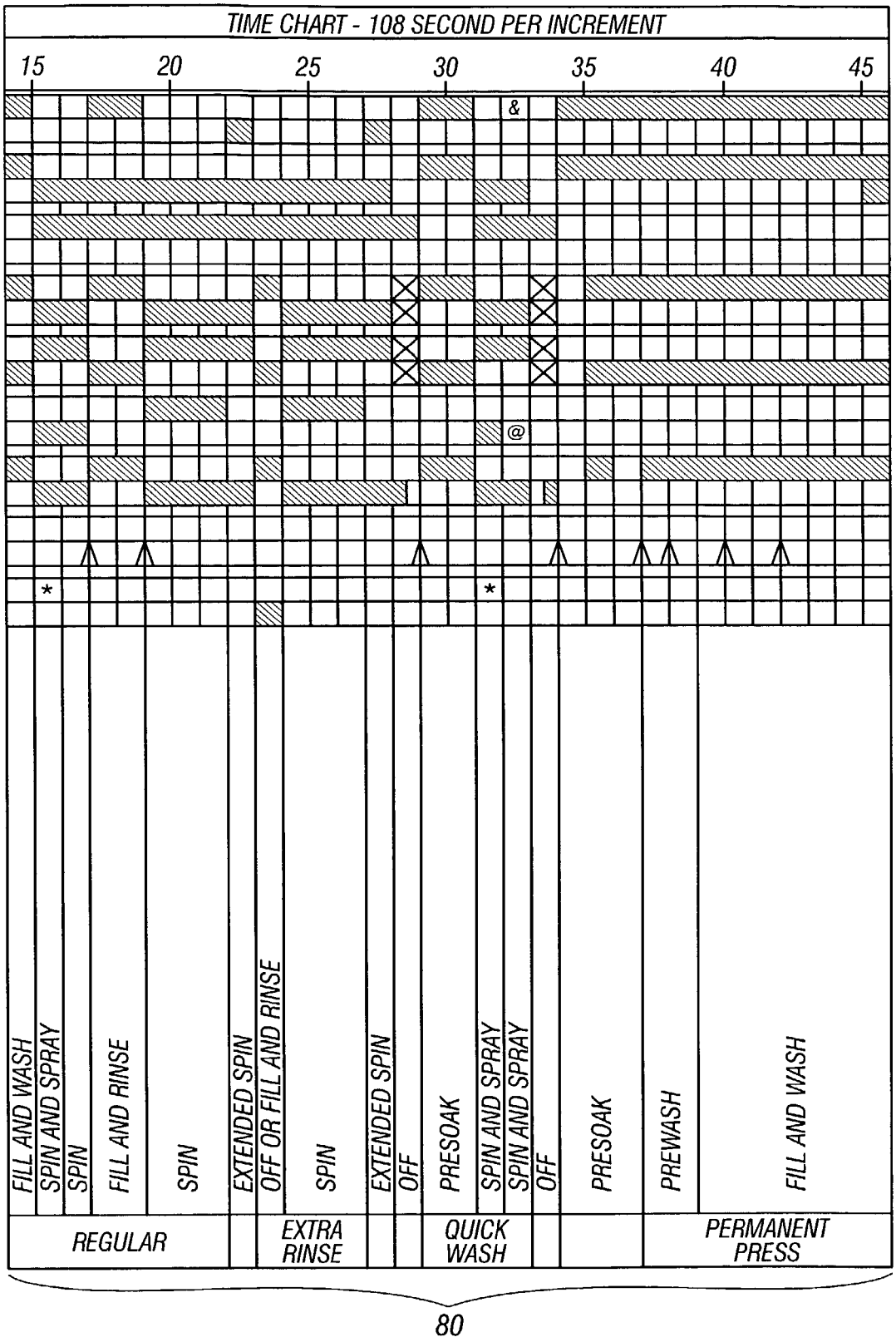
Figure 4C:
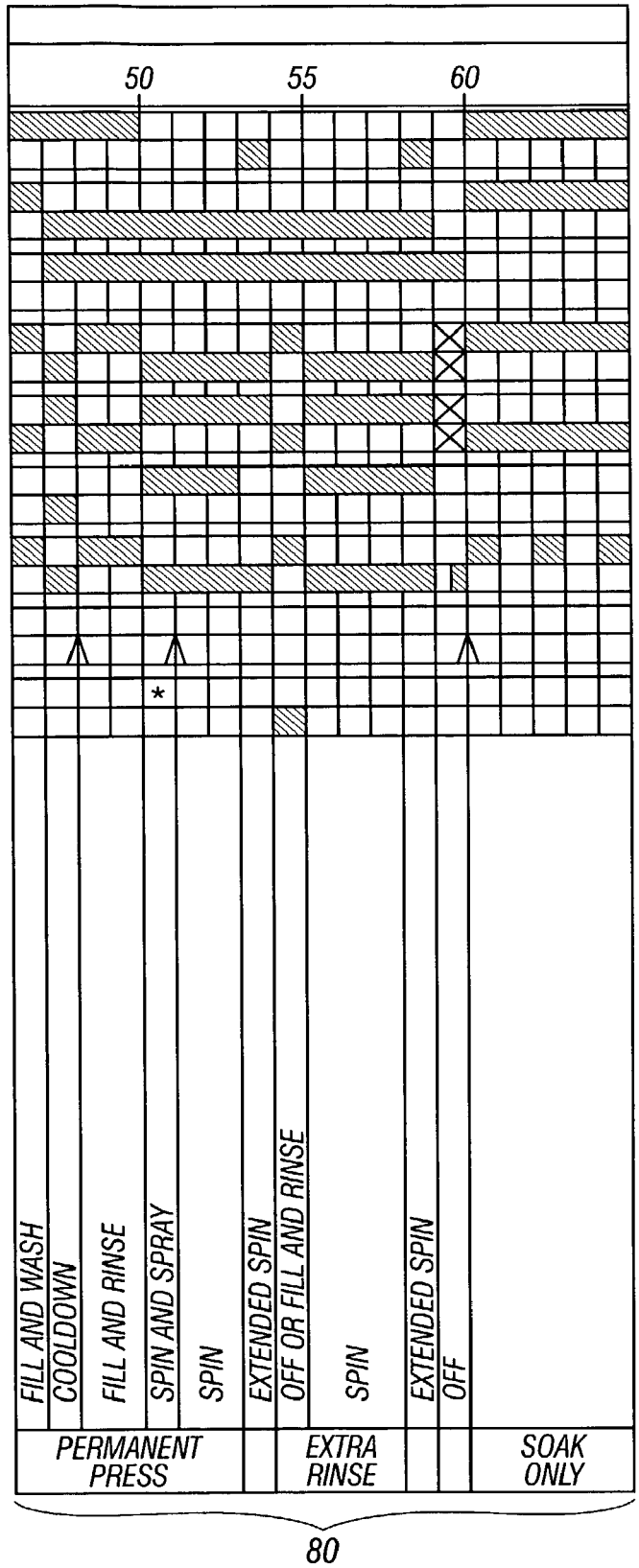

FIGS. 4A–4C provide a timing chart associated with the timer 14 of the present invention. The timing chart shown in FIG. 4 is merely to aid in the description and to illustrate that the present invention uses both an electromechanical timer in addition to an intelligent control 18. The timer 14 controls the timing aspects of the various laundry cycle functions. In a preferred embodiment, the electromechanical timer is used to control laundry functions such as presoak, prewash, fill and wash, spin and spray, spin, maximum extract, or other functions. The present invention contemplates that these or other functions can be associated with various types of laundry cycles including a regular cycle, an extra rinse cycle, a quick wash cycle, a permanent press cycle, or other cycles. As shown in FIG. 4A, the timer 14 includes a plurality of cams. One cam 62 is associated with the fill and agitate control functions and extended spin functions. Another cam 64 is associated with wash fill and rinse fill functions. Yet another cam 66 is associated with intermittent speed slow and intermittent speed fast functions. The next cam 68 is associated with reversing agitate function and reversing spin function. Another cam 70 is associated with reversing spin function and reversing agitate function. Another cam 72 is associated with selected speed spin function and assured high speed function. Another cam 74 is associated with selected speed agitate and spin and timer motor 14 bypass. Another cam 76 is associated with detents which provide a tactile feedback to assist with user selections. Another cam 78 is associated with sub-interval spray and extra rinse functions. The washer functions are shown in columns 80. The washer functions shown correspond with the occurrence of functions associated with the various cams. The present invention contemplates numerous variants on the cycles used, the laundry functions performed, and the timing durations associated with the cycles and functions.

Figure 5A:
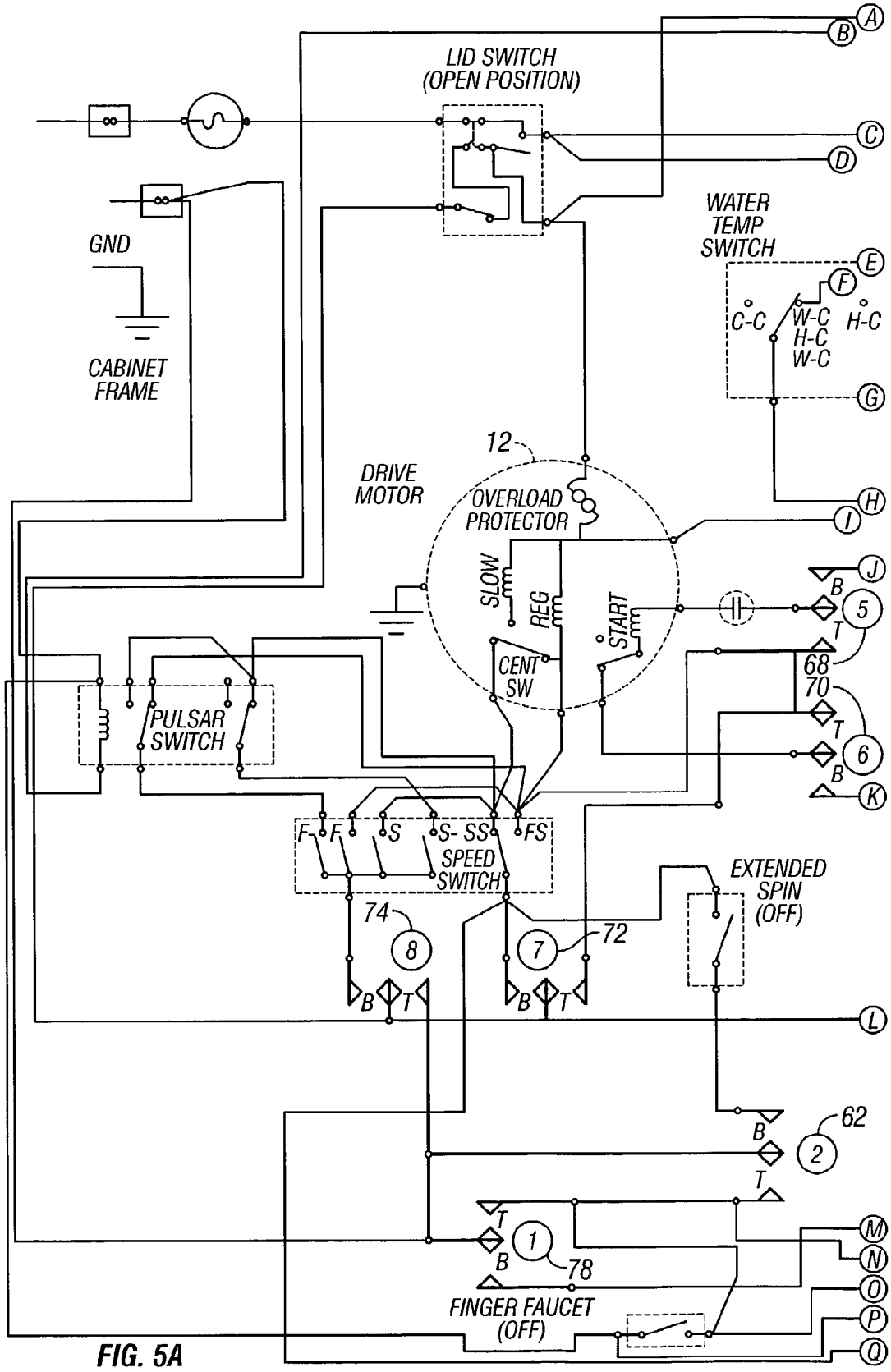
FIGS. 5A–5B are a detailed schematic according to one embodiment of the present invention.
Figure 5B:
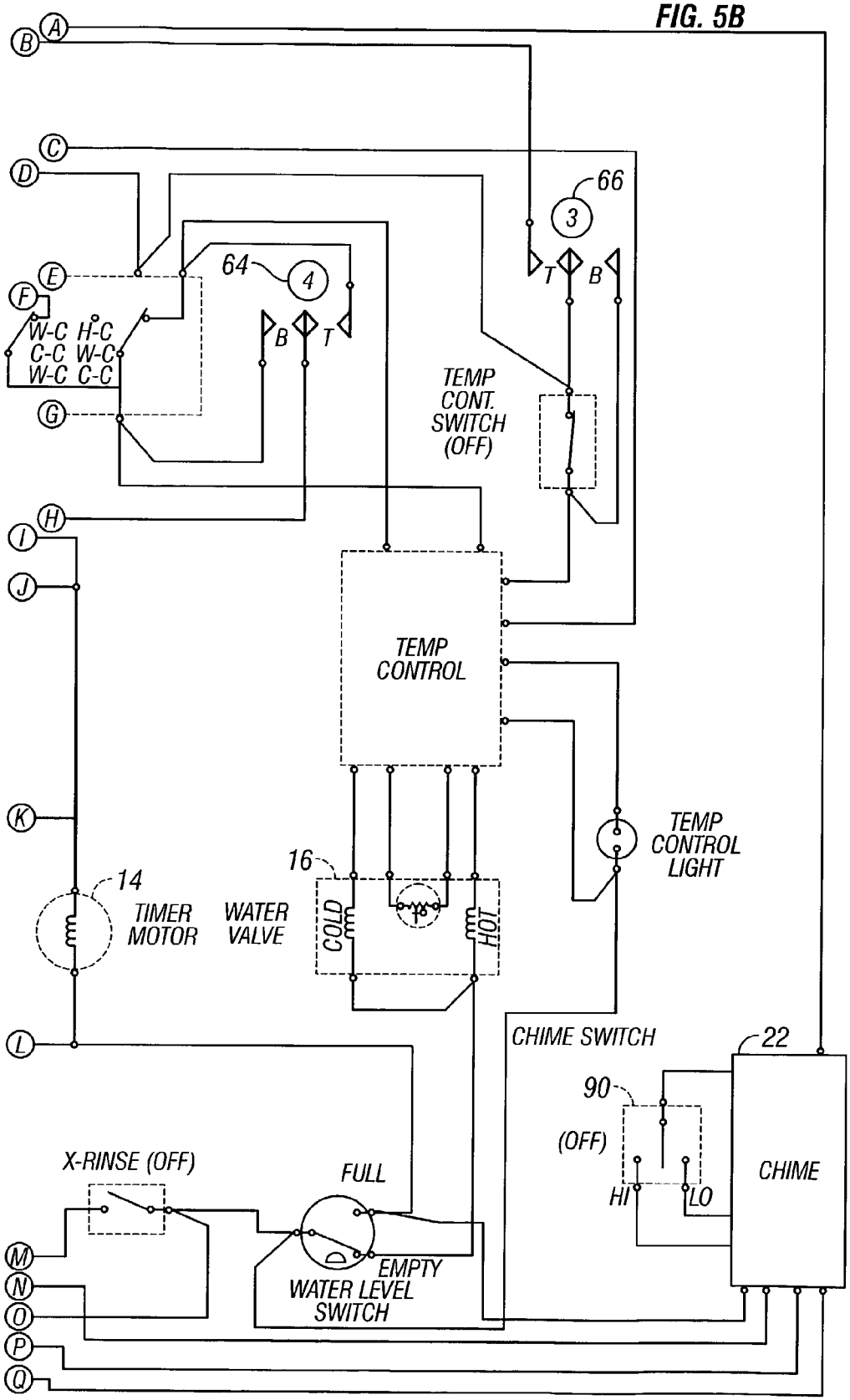

FIGS. 5A and 5B provide a detailed schematic of the electromechanical control of the present invention. The placement of various cams associated with the timer 14 are shown. In addition, the chime unit 22 that includes the intelligent control 18 and audio circuit 20 is also shown electrically connected to the water valve 16, the timer motor 14, and the drive motor 12. A chime switch 90 is also shown that is electrically connected to the chime unit 22 for selecting whether the chime is turned on or off or whether the volume of the chime is set to a high volume or a low volume. FIGS. 5A and 5B are provided merely to illustrate how the intelligent control 18 of the chime unit 22 is used in addition to the electromechanical timer motor 14 with its various cams. The number of cams, the specific configuration of the cams, and the assignment of the cams to various laundry appliance functions can vary widely as a particular application, environment, or design criteria may require, suggest, or render expedient.

Figure 6:
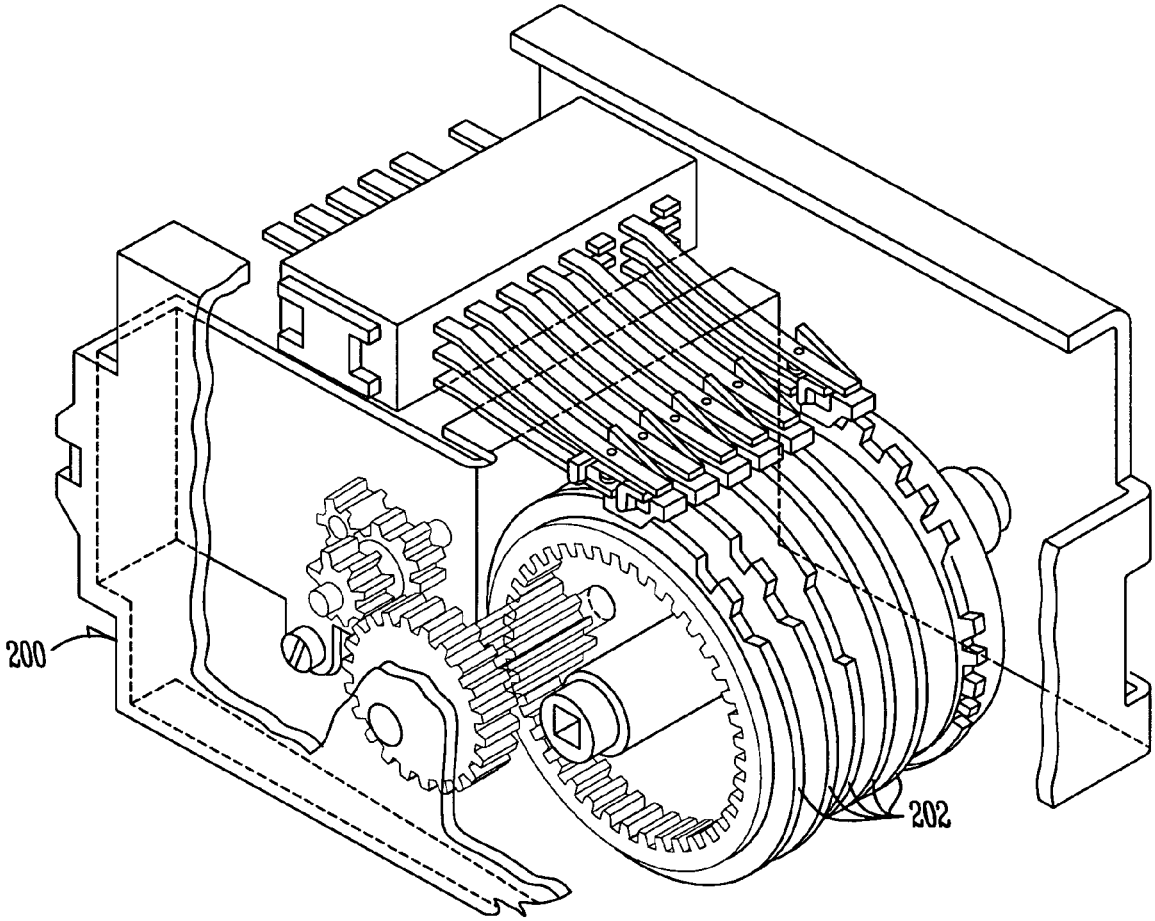
Fig. 6 (PRIOR ART)
FIG. 6 illustrates a conventional timer having cams as may be used in the present invention.

FIG. 6 illustrates a conventional timer 200 having cams 202 which may be used in the present invention.

Although a preferred embodiment of the present invention is shown, the present invention contemplates numerous variations. For example, in the methodology, the intelligent control need not continuously check whether the time duration has occurred (busy wait), instead, such an event may be interrupt driven. In addition various intelligent controls can be used. These and other variations are well within the spirit and scope of the present invention.

What is claimed is:

1. A method of producing an end of cycle signal for a laundry appliance, having a drive motor, a timer motor, and at least one water valve, comprising:

(a) determining that the drive motor was previously running, and is presently turned off;

(b) determining that the timer motor is not currently running;

(c) determining that the at least one water valve is closed; and (d) producing a signal to indicate an end of cycle.

2. The method of claim 1 wherein the step of producing a signal includes producing an audible signal.

3. The method of claim 2 wherein the audible signal is a chime.

4. The method of claim 1 wherein steps (a), (b), and (c) are performed by an intelligent control.

5. The meted of claim 4 wherein the intelligent control is a microcontroller.

6. A laundry appliance, comprising:

a drive motor;

a timer motor;

at least one water valve;

an intelligent control electrically connected to the drive motor, the timer motor, and the at least one water valve and adapted for determining an end of cycle signal by determining that the drive motor is turned off and determining that the timer motor is not running and that the at least one water valve is closed.

7. The laundry appliance of claim 6 further comprising an audio circuit electrically connected to the intelligent control for receiving the end of cycle signal and producing an audible tone.

8. The laundry appliance of claim 7 wherein the audible tone is a chime.

9. A laundry appliance, comprising:

a drive motor;

at least one water valve;

a timer motor having a plurality of timer cams associated with timing of laundry functions, the timer cams controlling timing of a laundry cycle;

an intelligent control electrically connected to the drive motor, the timer motor, and the at least one water valve and adapted for generating an end of cycle signal when the inteillgent control determines that the drive motor is turned off, the timer motor is not running and the at least one water valve is closed.

10. The laundry appliance of claim 9 wherein the intelligent control is a microcontroller.

11. The laundry appliance of claim 9 further comprising an audio circuit electrically connected to the intelligent control and wherein the intelligent control is adapted to provide the end of cycle signal to the audio circuit to generate a tone.

12. The laundry appliance of claim 11 wherein the tone is a chime.

13. A method of producing an end of cycle signal for a laundry appliance, having a drive motor, a timer motor having a plurality of cams associated with timing of laundry functions, and at least one water valve, comprising;

(a) sensing that the drive motor was previously running, and is presently turned off using an intelligent control:

(b) sensing that the timer motor is not currently running using the intelligent control;

(c) sensing that the at least one water valve is closed using the intelligent control; and (d) producing a signal to indicate an end of cycle using the intelligent control.

14. The method of claim 13 wherein the step of producing a signal includes producing an audible signal.

15. The method of claim 14 wherein the audible signal is a chime.

16. The method of claim 13 wherein the intelligent control is a microcontroller.

* * * * *